US005853087A

United States Patent [19]

Sos et al.

[11] Patent Number: 5,853,087

[45] Date of Patent: Dec. 29, 1998

[54] PACKING RECEPTACLE, PARTICULARLY FOR SEWING MACHINE NEEDLES

[75] Inventors: Siegmund Sos; Artur Hoch, both of Albstadt; Susanne Merkle, Bitz, all of Germany

[73] Assignee: Groz Beckert KG, Albstadt, Germany

[21] Appl. No.: 969,674

[22] Filed: Nov. 13, 1997

[30] Foreign Application Priority Data

Nov. 13, 1996 [DE] Germany ..... 196 46 845.0

[51] Int. Cl.[6] ..... B65D 85/24

[52] U.S. Cl. ..... 206/380; 206/443; 220/324

[58] Field of Search ..... 206/214, 224, 206/379, 380, 443; 220/324

[56] References Cited

U.S. PATENT DOCUMENTS

| | | | |
|---|---|---|---|
| 1,024,388 | 4/1912 | Barlett | 206/379 |
| 1,982,112 | 11/1934 | Lang | 206/380 |
| 3,790,061 | 2/1974 | Pignato | 220/324 |
| 3,913,741 | 10/1975 | Pirie . | |
| 4,765,473 | 8/1988 | Pavel et al. . | |
| 5,391,322 | 2/1995 | Mayeaux . | |

FOREIGN PATENT DOCUMENTS

| | | |
|---|---|---|
| 0 256 387 | 2/1988 | European Pat. Off. . |
| 0 379 620 | 8/1990 | European Pat. Off. . |
| 0 477 401 | 4/1992 | European Pat. Off. . |
| 1132504 | 3/1957 | France . |
| 20 39 701 | 2/1971 | Germany . |
| 30 30 208 | 3/1982 | Germany . |
| 795748 | 5/1958 | United Kingdom . |

*Primary Examiner*—Jim Foster
*Attorney, Agent, or Firm*—Venable; Gabor J. Kelemen

[57] ABSTRACT

A packing receptacle for elongated articles includes a receiving part having a holding arrangement for individually positioning the articles therein; and a lid part having a first position in which the lid part is arranged on, and defines an article-receiving space with, the receiving part and a second position in which the lid part is removed from the receiving part. The article-receiving space has a removal opening through which the articles may be removed from the packing receptacle. A hinge interconnects the receiving part with the lid part for allowing a pivotal movement of the lid part about a hinge axis of the hinge from the second position into the first position. An anchoring device secures the lid part to the receiving part when the lid part is in the first position. Further, a closure arrangement is articulated to the lid part and/or the receiving part for movement into a closed position to block the removal opening and into an open position to unblock the removal opening.

15 Claims, 3 Drawing Sheets

PACKING RECEPTACLE, PARTICULARLY FOR SEWING MACHINE NEEDLES

CROSS REFERENCE TO RELATED APPLICATION

This application claims the priority of German Application No. 196 46 845.0 filed Nov. 13, 1996, which is incorporated herein by reference.

BACKGROUND OF THE INVENTION

This invention relates to a packing receptacle, particularly for sewing machine needles or similar elongated items (hereinafter also referred to collectively as "articles").

Sewing machine needles are at the present time still packaged, for example, in small bags or boxes in which a predetermined number of needles are accommodated and whose length is slightly larger than the needle length. The handling of such receptacles is impractical when individual needles are to be removed. For example, to remove a single needle from a bag, its contents have to be carefully shaken partially out of bag to such an extent that one needle may be grasped and lifted out of the bag. Also, it is not always simple to remove a single needle from a box which contains a great number of side-by-side disposed needles.

A clearer presentation of packaged sewing machine needles and elongated articles as well as a facilitated removal thereof may be made possible with a receptacle for sewing machine needles and elongated articles disclosed in German Offenlegungsschrift (application published without examination) No. 20 39 701. The receptacle disclosed therein has a cross-sectionally essentially U-shaped bottom or receiving part which on its upper side is provided with parallel, cross-sectionally V-shaped grooves that form devices for the orderly accommodation of side-by-side lying articles. A lid which may be locked to the lateral rims of the bottom part and which is longitudinally slidably supported therein, frictionally holds the articles positioned in the grooves. For this purpose the lid carries on its inside a foam cushion which presses on the articles lying in the grooves. An axial displacement of the lid relative to the bottom part allows the articles to be shifted together in the grooves; as a result, their end portions project beyond the end face of the bottom part and thus the articles may be individually grasped for removal. In such a receptacle the packaged articles, however, are not protected on all sides against external effects which is particularly undesirable in case of sewing machine needles.

In another packing arrangement, particularly for sewing machine needles and the like, disclosed in German Offenlegungsschrift No. 30 30 208, on a base plate constituted by a deep-drawn plastic sheet groove-like receiving parts are provided for the individual accommodation of the articles in a surface region which is less than one-half of the base plate area. The needles are stored airtight by means of a transparent cover film sealed to the grooved zone of the base plate. The remaining surface area of the base plate which is separated by a fold line from the surface that receives the articles, is provided with retaining projections which, when snapped in a lid-like manner onto the partial surface, engages counterholding means in the zone of the partial surface. The package is a "suspended package", that is, the base plate, together with the sewing machine needles packed airtight, may be hung on a stand or the like. The transversely extending fold line permits the purchaser to fold the package in half and place it in his/her pocket with ease. For removing the individual packaged articles, first, however, the base plate has to be brought into its original, unfolded condition and thereafter the sealed covering foil has to be torn or pulled off at least to such an extent until at least one article is exposed so that it can be grasped and removed. Such suspended packages are intended for the household consumer; they are practically not adapted for industrial distribution.

Further, according to U.S. Pat. No. 4,765,473, sewing machine needles are pressed in predetermined quantities into a flat, cross-sectionally rectangular foam body and the needle-filled foam bodies are placed in a collecting receptacle which is formed essentially of two U-shaped parts. The U-shaped parts are offset by 90° to one another and assembled in this orientation to form a receptacle such that the U-shaped parts are held on one another by means of their parallel legs. Such a package is complex and expensive to manufacture.

SUMMARY OF THE INVENTION

It is an object of the invention to provide an improved packing receptacle, particularly for sewing machine needles or similar elongated articles which makes possible a secure and simple handling of the articles during filling and removal and which provides for a superior protection of the packaged articles against mechanical damage and corrosion.

This object and others to become apparent as the specification progresses, are accomplished by the invention, according to which, briefly stated, the packing receptacle for elongated articles includes a receiving part having a holding arrangement for individually positioning the articles therein; and a lid part having a first position in which the lid part is arranged on, and defines an article-receiving space with, the receiving part and a second position in which the lid part is removed from the receiving part. The article-receiving space has a removal opening through which the articles may be removed from the packing receptacle. A hinge interconnects the receiving part with the lid part for allowing a pivotal movement of the lid part about a hinge axis of the hinge from the second position into the first position. An anchoring device secures the lid part to the receiving part when the lid part is in the first position. Further, a closure arrangement is articulated to the lid part and/or the receiving part for movement into a closed position to block the removal opening and into an open position to unblock the removal opening.

Thus, the packing receptacle according to the invention includes a flat receiving part which, on one face, carries holding means for the individual articles to be packaged and further has a flat lid portion which is connected with the receiving part by means of a hinge, preferably an "integral hinge", that is, a flexible plastic part interconnecting the receiving part and the lid part as a unitary component of the two parts. The lid part may be snapped onto the receiving part to thus form an accommodation space therewith for the articles held by the holding means. The snapped-on lid part is thereafter permanently anchored to the receiving part by securing means so that a stable packing receptacle is obtained. On the side facing the hinge, closure means are arranged which are jointedly connected with the lid part and/or the receiving part. The closure means may be pivoted between an open position which frees (unblocks) a removal opening leading into the accommodation space of the receptacle and a closed position in which the removal opening is blocked.

Advantageously, the article holding means have side-by-side arranged ribs which together define side-by-side arranged elongated receiving grooves or pockets for the articles which may be positioned individually in the grooves or pockets in a loosely lying relationship. In principle, however, it is also feasible to provide on the groove bottom or pocket bottom or on the inside face of the lid part, a pressure cushion made, for example, of foam material in order to hold the articles firmly by frictional engagement. According to a preferred embodiment the closure means have side-by-side arranged individual closure elements which have a width that equals one part of the width of the removal opening and which may be operated independently from one another. The closure elements may be clasp-like members which are articulated to the lid part and/or the receiving part at one end and may be snap-locked with the respective other part at their other end. The clasps are cross-sectionally essentially L-shaped and are connected with the lid part and/or the receiving part by an integral hinge. They may interlock with a snap-in edge provided on the facing receiving part or lid part.

The components of the packing receptacle according to the invention are made of a synthetic material, such as polyethylene and are advantageously injection-molded. If the receiving part and the lid part are connected by an integral hinge then these components constitute a one-piece unit. The articles are inserted in the receiving means of the receiving part when the lid part is in the open, flat-lying position, adjoining the receiving part. The inserting operation may be performed fully automatically. Thereafter, the lid part is pivoted 180° about the hinge axis and is securely connected with the receiving part by means of the securing means. At the same time, the closure means formed, for example, on the lid part, is interlocked with the oppositely located part such as the receiving part, to thus complete the packaging process. The receptacle formed by the lid part and the receiving part protects the articles against mechanical damage and against external environmental effects, such a water. The plastic material from which the packing receptacle is made may contain a volatile corrosion inhibitor (VCI) which automatically provides for a protection against corrosion of the packaged metallic articles. Since the packing receptacle may be made in its entirety of pure synthetic material, it may be readily recycled after emptying. By using a transparent synthetic material, the packaged articles may be visually inspected from the outside at all times. The removal of articles from the packing receptacle is very simple: merely the closure means blocking the removal opening needs to be opened, and it may be closed after the selected article has been removed. When using the earlier-mentioned L-shaped clasps as closure means, whose width is less than the width of the receiving part, the removal opening is selectively unblocked only for removing one or two articles. Such articles may be simply shaken out or pulled out through the unblocked part of the removal opening of the packing receptacle without any risk that additional articles will also fall out.

To avoid that short packaged articles, such as sewing machine needles are shifted axially back and forth during transport to thus risk damage to the needle points, between the receiving part and the lid part expediently at least one abutting means is arranged which extends at least over one part of the holding means and which limits the axial displacement of the articles. Such abutting means may be formed of plastic transverse strips positioned in the respective receiving grooves of the article holding means.

According to an advantageous feature of the invention, to provide for a stackability of the closed packing receptacles, the lid part and/or the receiving part carries positioning means arranged such that when the packing receptacles are stacked face-to-face, the positioning means of adjoining packing receptacles interengage in a form-fitting manner.

The packing receptacle according to the invention is adapted particularly for sewing machine needles; because of the possibility of a purposeful release of individual sewing machine needles or of small groups (such as pairs of such needles), the packing receptacle may also be designated as a "needle dispenser". Basically, however, the packing receptacle according to the invention may also designed for receiving round, flat, rectangular, prismatic or other small, precision components. The needles adapted to be received by the packing receptacle according to the invention may be straight or bent (round needles); this applies to the same extent to the above-noted precision components which may have any desired shape.

DESCRIPTION OF THE PREFERRED EMBODIMENTS

Figure 1:
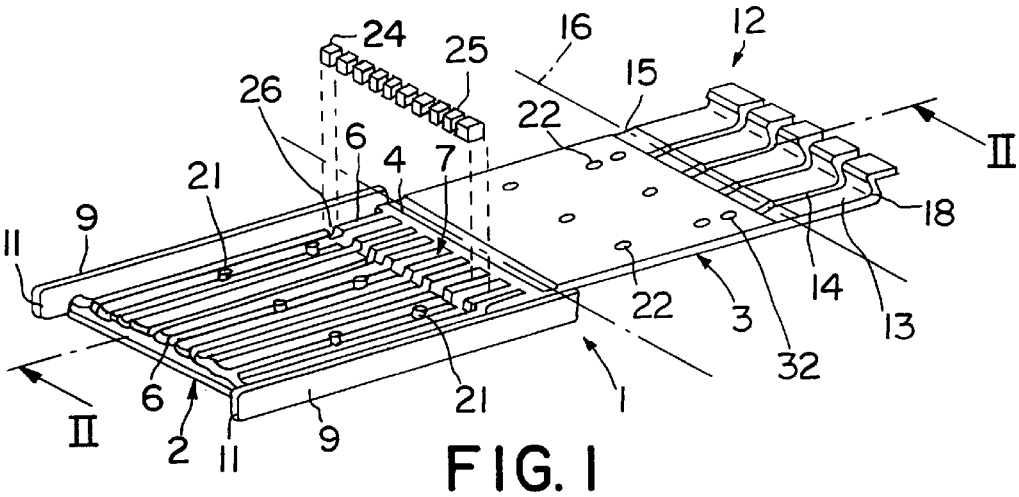
FIG. 1 is a perspective view of a preferred embodiment of the invention shown in an open, empty state.

The packing receptacle to be described in two embodiments in conjunction with the drawings is designed as a needle dispenser. The packing receptacle is formed of an injection-molded plastic component 1, expediently made of a polyolefin, for example, polyethylene. The one-piece plastic component 1 which has a rectangular, elongated outline in plan view, has a receiving part 2 and a flat lid part 3 connected end-to-end to the receiving part 2 by an integral hinge 4. The receiving part 2 has a planar, plate-like bottom portion 5 (FIG. 2) which has parallel spaced, formed-on webs or ribs 6 on its upper surface. Adjoining webs 6 define longitudinally extending grooves 7 (FIG. 1), each adapted to accommodate a sewing machine needle designated at 8 in FIG. 4. The ribs 6 and the grooves 7 thus form holding means dimensioned according to the diameter and length of the sewing machine needles 8.

On the bottom portion 5, along its two opposite longitudinal sides, two parallel, upright strips 9 are formed which are connected with one another in the region of the integral hinge 4 by means of a transverse end wall 10 also formed on the bottom portion 5 and which lend the flat receiving part 2 an essentially trough or dish-shaped configuration. As may be particularly well observed in FIGS. 1 and 2, the strips 9 project at 11 beyond the longitudinal dimension of the grooves 7.

The lid part 3 is, at its edge region remote from the integral hinge 4, provided with closure means 12 formed of cross-sectionally essentially L-shaped, side-by-side disposed closure clasps 13 cut from the lid part 3 and separated from one another by a narrow longitudinal slot 14. The width of each closure clasp 13 is less than the width of the lid part 3. The closure clasps 13 are each connected with the lid part 3 by an integral hinge 15 whose hinge axis 16 extends transversely to the longitudinal direction of the grooves 7 and parallel to the hinge axis 17 of the integral hinge 4 of the lid part 3.

Figure 4:
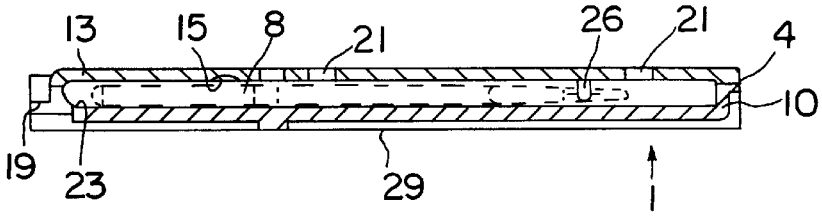
FIG. 4 is a sectional view, on an enlarged scale, taken along line IV—IV of FIG. 3.
Figure 5:
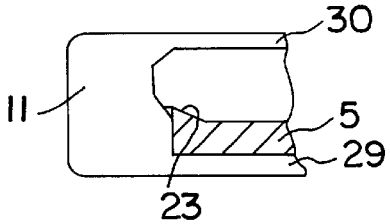
FIG. 5 is a fragmentary sectional elevational view of the construction shown in FIG. 4, illustrated on an enlarged scale.

Each closure clasp 13 is, at its edge oriented towards the integral hinge 4, provided with a detent lug 18 extending along the width of the clasp for interlocking, in the closed state of the packing receptacle, with the free terminal edge 20 of the bottom 5 of the receiving part 2, as it may be observed, for example, in FIG. 4. From that edge of each closure clasp 13 which is opposite the detent lug 18, a tab 19 projects which is engageable by the user to pivot open the closure clasp 13.

Figure 2:
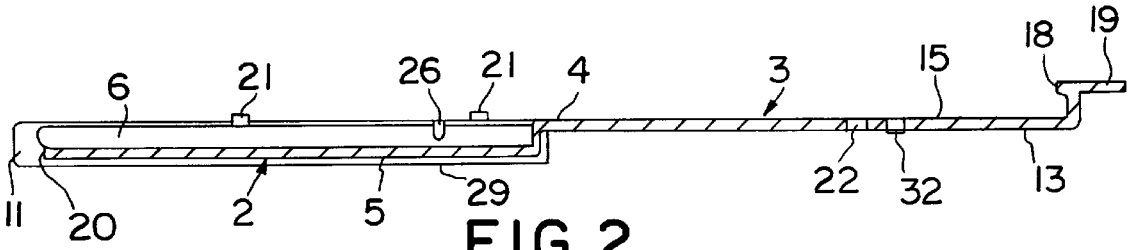
FIG. 2 is a sectional view, on an enlarged scale, taken along line II—II of FIG. 1.

The above-described packing receptacle is filled with sewing machine needles 8 in its flat-lying, open state (as obtained directly upon manufacturing of the receptacle), that is, with the lid part 3 pivoted outwardly as shown in FIGS. 1 and 2. This operation is preferably performed with an automatic device which deposits one needle in each groove 7 (FIG. 4). Thereafter the lid part 3 is pivoted 180° about the hinge axis 17, and then the detent lugs 18 are snapped into the frontal edge 20 of the bottom 5 of the receiving part 2 and form therewith a releasable snap connection.

As particularly well seen in FIGS. 1 and 2, on three of the nine ribs 6 securing means constituted by projecting anchoring pins 21 are provided which, upon closing of the lid part 3, lock into associated elongated holes 22 of the lid part 3. The thus-closed needle dispenser may, by virtue of the provision of the press-fitted "pin-and-slot" connection 21, 22 be regarded as an undetachable (permanently closed) unit in which the receiving part 2 and the closed lid part 3 together define a receiving space for the sewing machine needles 8. The receiving space is laterally closed off by the strips 9 and the frontal wall 10, while the removal opening of the receiving space is blocked by the closure clasps 13. The anchoring pins 21 projecting through the slots 22 may be welded or glued to the lid part 3.

To facilitate the removal of the sewing machine needles 8 from the removal opening bounded by the bottom portion 5, the lateral strips 9 and the lid part 3, the bottom portion 5 is provided on the inside with a transversely extending chamfered ramp 23 in the region of the free terminal edges 20, as shown in FIG. 4. The ramp 23 which extends at an angle of inclination of approximately 30°, lifts the end of the needles slightly as the needles are pushed out of the grooves, facilitating the grasping of the needles. The ramp 23, however, offers a sufficient resistance in order to prevent the sewing machine needles 8 from dropping out when a closure clasp 13 is in a flipped-open state.

Figure 6:
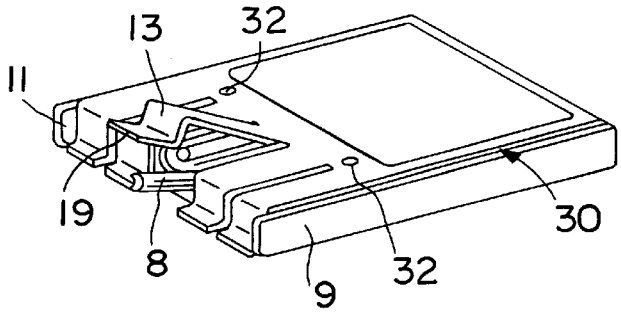
FIG. 6 is a perspective view of the structure shown in FIG. 3, illustrated in a state permitting removal of two sewing machine needles.

As it was noted earlier, the width of the closure clasps 13 is less than the width of the removal opening; in the described embodiment such width corresponds essentially to the width of two adjoining grooves 7. Since the closure clasps 13 may be individually and selectively moved (flipped open) from their closed position shown in FIG. 3 into the open position as shown in FIG. 6, it is feasible to select from the essentially transparent packing receptacle a particular needle pair and remove the same without changing the packaging state of the remaining needles 8 or exposing them through the removal opening. It is to be understood that the width of the closure clasps 13 may be selected according to requirements, it may thus have the width of a single groove 7.

After removal of the desired sewing machine needles 8, the packing receptacle may be again closed in a simple manner by pushing back the earlier-opened closure clasp 13 onto the bottom portion 5 until the detent lug 18 snaps behind the terminal edge 20.

Figure 3:
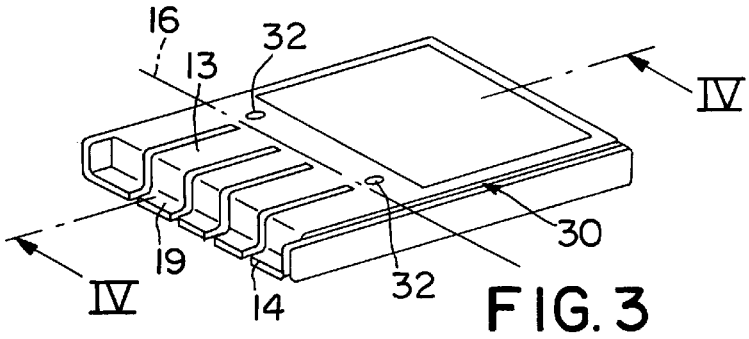
FIG. 3 is a perspective view of the structure shown in FIG. 1, illustrated in a closed state.

The closure clasps 13 are, as shown, for example, in FIG. 3, positioned in the frontal third of the lid part 3. On the remaining contiguous region of the external face of the lid part 3 between the hinge axes 16 and 17 messages concerning contents, manufacturer or the like may be applied by direct printing or by means of a label. In individual cases it is also feasible to provide in such a zone a window in the receiving part 2 or in the lid part 3 so that the packaged articles may be directly visually observed. If expedient, the closed packing unit according to FIG. 3 may be surrounded by a sleeve or a wrapper having a tear-open string which, until the first opening, ensures the integrity of the package and/or provides an airtight seal.

The sewing machine needles 8 lie individually in the grooves of the receiving part 2 loosely with a lateral play. To adapt a packing receptacle, designed for a certain needle length, to shorter needles, a transverse abutment strip 24 may be inserted into the receiving part 2 as shown, for example, in FIG. 1. The cross-sectionally quadratic elongated abutment strip 24 extends between the inner faces of the two lateral strips 9. The abutment strip 24 is provided with transverse grooves 25 whose spacing corresponds to that of the ribs 6 and is inserted into receiving grooves 26 of the ribs 6 in such a manner that each needle-receiving groove 7 is bounded over its entire height and inner width by an endwise abutment, thus effectively reducing the length of the grooves 7. Such an abutment and the shortening of the groove length resulting therefrom prevent an undesired longitudinal shifting and acceleration of the packaged short sewing machine needles 8 during transport or in case the packing receptacle is shaken.

Figure 7:
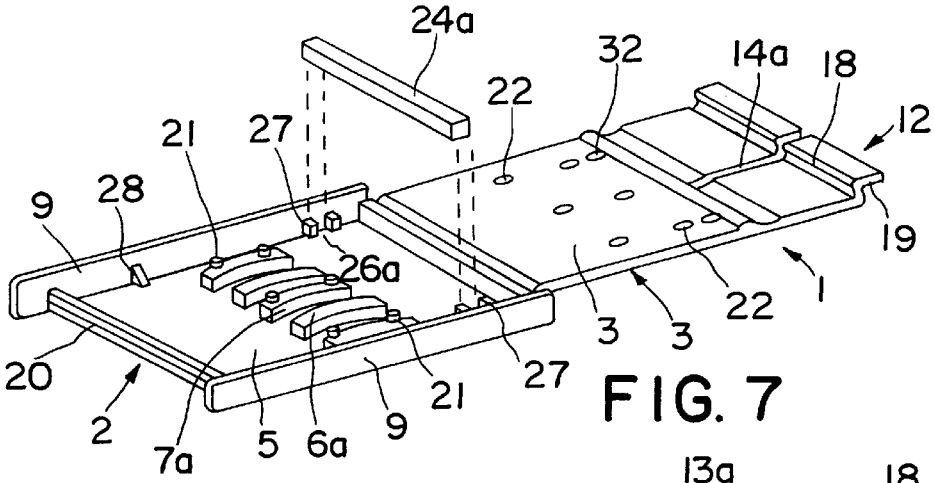
FIG. 7 is a perspective view of another preferred embodiment of the invention shown in an open, empty state.
Figure 8:
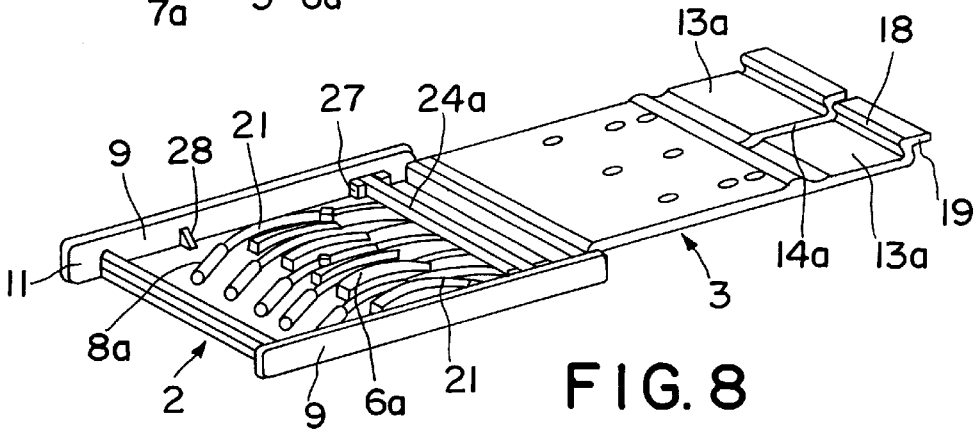
FIG. 8 is a perspective view of the preferred embodiment of FIG. 7, shown in an open state and accommodating curved machine needles.
Figure 9:
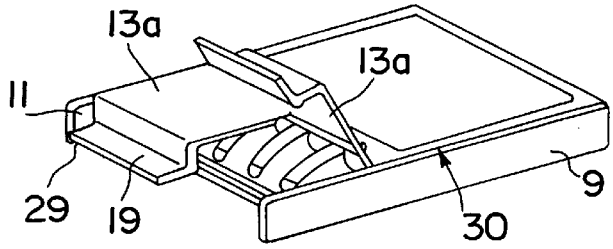
FIG. 9 shows the embodiment of FIGS. 7 and 8, illustrated in a state permitting, similarly to FIG. 6, removal of two sewing machine needles.

The packing receptacle described above in conjunction with FIGS. 1–5 is intended for elongated, essentially straight articles, particularly sewing machine needles 8. The packing receptacle according to the invention may basically also be designed for packaging differently shaped, for example, bent or arcuate articles without departing from the packing principle according to the invention. A preferred embodiment adapted for such a purpose is illustrated in FIGS. 7, 8 and 9. The packing receptacle shown therein, also designed as a needle dispenser, serves as a package for arcuate articles, for example, arcuately bent needles 8*a*.

The packing receptacle shown in FIGS. 7, 8 and 9 is constructed essentially identically to the packing receptacle of FIGS. 1–5. The embodiment according to FIGS. 7, 8 and 9 is different as concerns the structure of the holding means. Instead of the straight flat ribs 6 there are provided, on the bottom portion 5, arcuately bent ribs 6*a* which extend only over a part of the length of the bottom portion 5. Side-by-side arranged ribs 6*a* in each instance define an arcuately bent groove 7*a* in which the arcuately bent needles 8*a*, having a cross-sectionally circular shaft portion, are received with lateral play as may be observed in FIG. 8.

The abutment strip 24*a* inserted into the receiving part 2 is an elongated, flat, smooth strip of square cross section which, at both ends, is held in a space 26*a* defined between a pair of blocks 27 formed on the respective lateral strip 9 and the bottom portion 5. The blocks 27 serve simultaneously for stiffening the connection between the lateral strips 9 and the bottom portion 5. Along each lateral strip 9, spaced from the respective blocks 27, triangular stiffening ribs 28 are formed which have the same stiffening role as the blocks 27.

In view of the fact that the illustrated packing receptacle is designed for accommodating only five curved needles 8*a*, only two closure clasps 13*a* are provided which are separated from one another by means of a slot 14*a* lying in the symmetry plane of the lid part 3 and the receiving part 2. In the open position each of the closure clasps 13 provide for a manual access to at least two curved needles 8*a* as it may be seen in FIG. 9.

The packing receptacles of both embodiments are designed to be stackable in the closed state so that they may be combined into purchase units which contain a predetermined number (ten, for example) of packing receptacles.

Figure 10:
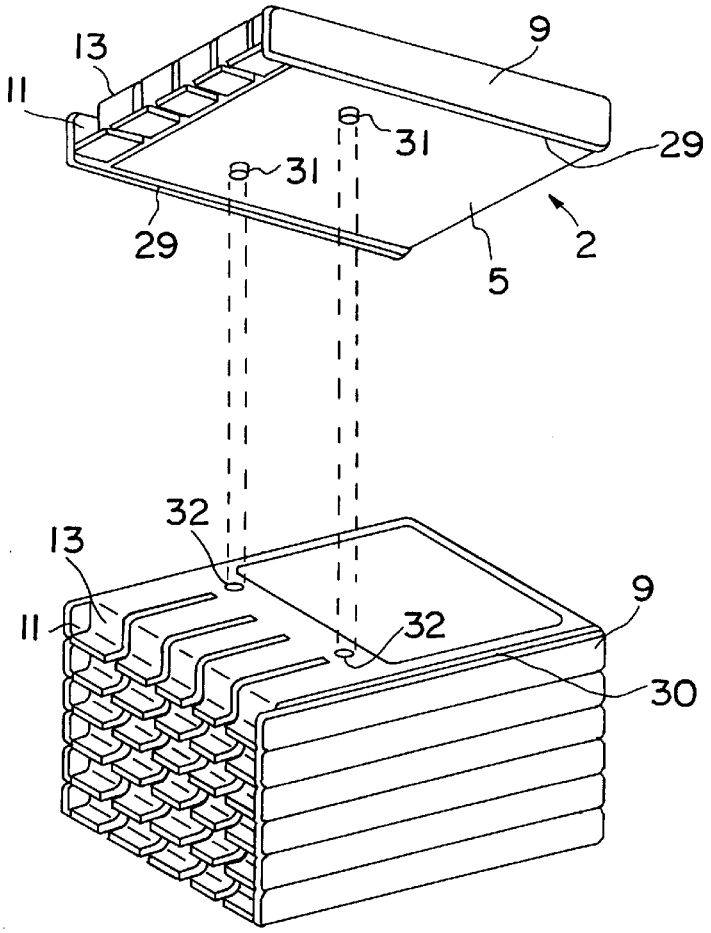
FIG. 10 is a perspective, exploded view of a stack of closed packing receptacles structured according to FIG. 3.

In the description which follows such a stacking feature will be described in conjunction with FIGS. 10 and 11.

As seen, for example, in FIGS. 2 and 4, the lateral strips 9 project at the lower edge region 29 downwardly beyond the bottom portion 5 so that longitudinal shoulders offset relative to the bottom surface are obtained. Further, the height of the lateral strips 9 is so designed that in the completed, ready-for-sale package, their upper longitudinal edge is slightly recessed at 30 (FIGS. 9 and 10) relative to the closed lid part 3 affixed to the receiving part 2 by means of the anchoring pins 21. Consequently, the stacked packing receptacles are prevented from relative transverse shifts by means of the projecting portion 30 of the lid part 3 of one packing receptacle, fitted between the downwardly projecting shoulders 29 of the lateral strips 9 of an immediately superposed packing receptacle.

For securing the stacked packing receptacles against longitudinal displacement relative to one another, at the underside of each packing receptacle holding means formed of two connecting pins 31 (FIG. 10) are provided, with which respective slots 32 in the lid part 3 are associated. The connecting pins 31 serve as a stacking implement and are received in the corresponding slots 32 when the packing receptacles are stacked.

The longitudinal, downwardly projecting shoulders 29 of the lateral strips 9, the upwardly projecting portion 30 of the lid part 3, the connecting pins 31 and the associated slots 32 together form holding means for form-fittingly positioning the packing receptacles on one another in the stacked state.

To prevent corrosion of the packaged sewing machine needles 8, 8*a*, a volatile corrosion inhibitor (VCI) known by itself is added to the synthetic material of the packing receptacle 1, for example, in a proportion of 2–20 weight percent.

Figure 11:
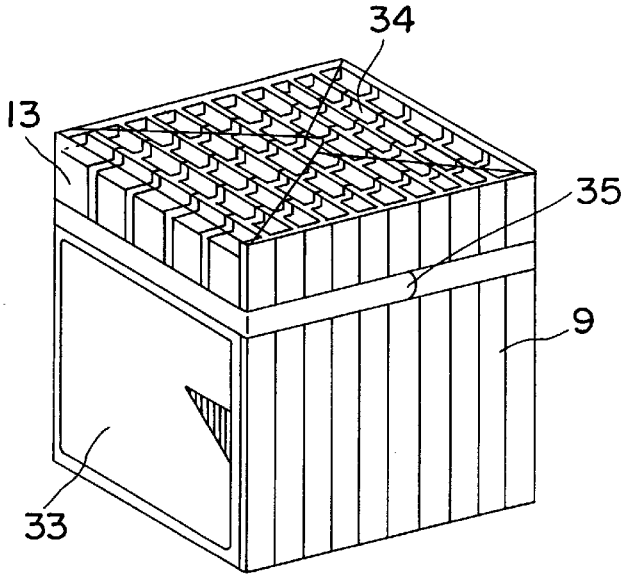
FIG. 11 is a perspective view of a stack of closed packing receptacles structured according to FIG. 3 and wrapped in a protecting film.

In the example shown in FIG. 11, ten packing receptacles stacked and interengaging in the above-described manner form a packaging unit. The top face of the lid part 3 of the outermost packing receptacle 1 may be provided with a message-containing label 33. The packaging unit is wrapped in a transparent film 34 which is provided with a tear-open string 35 arranged, for example, 12.5 mm from the upper unit edge where the closure clasps 13 are located. The film wrapper 34 prevents the volatile corrosion inhibitor (VCI) from escaping. As seen in part in FIG. 11, overlapping flaps of the transparent film 34 are situated at those faces of the packaging unit which are formed by the front and rear faces, as well as a side face of the individual packing receptacles. Thus, that face of the packaging unit, which is constituted by the top face of the lid part 3 of an outermost receptacle 1 and which carries the label 33 is free from such wrapper overlaps. To form an even larger packaging unit, five ten-block units (such as shown in FIG. 11) may be placed in a shipping box.

In the illustrated and described embodiments of the packing receptacle according to the invention the closure clasps 13, 13*a* are in each instance formed on the lid part 3. It is, however, feasible to provide the closure clasps or similar blocking elements only on the receiving part 2 or on both the lid part 3 and the receiving part 2. Dependent upon the configuration of the articles to be packaged, the bottom portion 5 may designed to be downwardly and outwardly pivotal in its region facing the closure clasps 13, 13*a* to thus further facilitate the removal of the articles.

It will be understood that the above description of the present invention is susceptible to various modifications, changes and adaptations, and the same are intended to be comprehended within the meaning and range of equivalents of the appended claims.

What is claimed is:

1. A packing receptacle for elongated articles, comprising (a) a receiving part including article holding means for individually positioning the articles therein;

(b) a lid part having a first position in which the lid part is arranged on, and defines an article-receiving space with, said receiving part and a second position in which said lid part is removed from said receiving part; said article-receiving space having a removal opening through which the articles may be removed from the packing receptacle;

(c) a hinge interconnecting said receiving part with said lid part for allowing a pivotal movement of said lid part about a hinge axis of said hinge from said second position into said first position;

(d) anchoring means for securing said lid part to said receiving part when said lid part is in said first position; and (e) closure means articulated to one of said parts for movement into a closed position blocking said removal opening and into an open position unblocking said removal opening.

2. The packing receptacle as defined in claim 1, wherein said article holding means comprises side-by-side arranged ribs defining side-by-side arranged grooves for the articles.

3. The packing receptacle as defined in claim 1, further comprising strips formed on opposite edge regions of one of said parts and extending perpendicularly to said hinge axis; said strips laterally bounding and laterally at least partially closing said article-receiving space.

4. The packing receptacle as defined in claim 1, wherein said anchoring means comprises cooperating detent elements provided on said receiving part and said lid part; said detent elements being in an interlocking state in said first position of said lid part.

5. The packing receptacle as defined in claim 1, further comprising form-locking means provided on at least one of said parts for causing a form-locking interengagement between two superposed, adjoining packing receptacles.

6. The packing receptacle as defined in claim 5, wherein said form-locking means include pins and recesses provided in said receiving part and said lid part; each said pin on one packing receptacle being received in a respective said recess on another, immediately superposed receptacle.

7. The packing receptacle as defined in claim 1, wherein said closure means include side-by-side arranged, individually operable closure elements articulated to one of said parts for movement into a closed position blocking one width portion of said removal opening and an open position unblocking said one width portion of said removal opening; each said closure element having a width being less than an overall width of said removal opening.

8. The packing receptacle as defined in claim 7, wherein said closure elements are closure clasps articulated to one of said parts; further comprising detent means for locking said closure clasps to the other of said parts in the closed position of said closure clasps.

9. The packing receptacle as defined in claim 8, wherein each said closure clasp has an essentially L-shaped cross section; further comprising an integral hinge separately articulating each said closure clasp to one of said parts.

10. The packing receptacle as defined in claim 9, wherein said detent means comprises a detent strip arranged on said other of said parts for locking said closure clasps to the other of said parts.

11. The packing receptacle as defined in claim 1, further comprising a chamfered ramp formed on said receiving part at an edge thereof adjoining said removal opening.

12. The packing receptacle as defined in claim 1, further comprising a common wrapper surrounding said lid part and said receiving part in said first position of said lid part.

13. The packing receptacle as defined in claim 1, further comprising an abutment member extending between said receiving part and said lid part transversely across at least some of said grooves for limiting a longitudinal displaceability of the articles in said grooves.

14. The packing receptacle as defined in claim 1, wherein said receiving part and said lid part are plastic.

15. The packing receptacle as defined in claim 14, wherein said plastic contains a volatile corrosion inhibitor.

* * * * *